US008550607B2

(12) United States Patent
Inoue et al.

(10) Patent No.: US 8,550,607 B2
(45) Date of Patent: Oct. 8, 2013

(54) INK JET RECORDING SYSTEM AND INK CONTAINER COMPRISING A LIGHT EMITTING PORTION

(75) Inventors: Ryoji Inoue, Kawasaki (JP); Yasuo Kotaki, Yokohama (JP); Tetsuya Ohashi, Matsudo (JP); Koichi Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 431 days.

(21) Appl. No.: 12/414,140

(22) Filed: Mar. 30, 2009

(65) Prior Publication Data

US 2009/0244217 A1 Oct. 1, 2009

(30) Foreign Application Priority Data

Mar. 31, 2008 (JP) ..... 2008-092167
Mar. 30, 2009 (JP) ..... 2009-082769

(51) Int. Cl.
*B41J 2/175* (2006.01)
*B41J 2/195* (2006.01)

(52) U.S. Cl.
USPC ..... 347/86; 347/7; 347/19

(58) Field of Classification Search
USPC ..... 347/86
See application file for complete search history.

(56) References Cited

U.S. PATENT DOCUMENTS

| | | | | |
|---|---|---|---|---|
| 7,350,910 | B2 | 4/2008 | Amma et al. | 347/86 |
| 7,384,116 | B2 | 6/2008 | Kotaki et al. | 347/19 |
| 2005/0151811 | A1 | 7/2005 | Shimizu et al. | 347/86 |
| 2005/0185034 | A1* | 8/2005 | Anma et al. | 347/86 |
| 2005/0213245 | A1* | 9/2005 | Katsura et al. | 360/125 |
| 2006/0082625 | A1* | 4/2006 | Kotaki et al. | 347/86 |
| 2006/0290722 | A1 | 12/2006 | Kitagawa et al. | 347/7 |
| 2007/0195141 | A1* | 8/2007 | Anma et al. | 347/86 |

(Continued)

FOREIGN PATENT DOCUMENTS

| | | |
|---|---|---|
| EP | 1650033 | 4/2006 |
| JP | 2005-205886 | 8/2005 |

(Continued)

OTHER PUBLICATIONS

Machine generated English translation of JP 2007-001212A to Kitagawa et al. "Substrate Unit for Ink Tank, Ink Tank Equipped With Substrate Unit, Ink Tank Holder Using Ink Tank and Inkjet Recorder," generated via http://www19.ipdl.inpit.go.jp/PA1/cgi-bin/PA1INDEX on Apr. 23, 2012; 23 pp.*

(Continued)

*Primary Examiner* — Shelby Fidler
(74) *Attorney, Agent, or Firm* — Fitzpatrick, Cella, Harper & Scinto

(57) ABSTRACT

An ink container for retaining ink includes an ink containing body, an elastically displaceable supporting member, a light emitting portion, a light receiving portion for receiving light from the light emitting portion, a display portion for displaying the received light, and a light guide portion for optically connecting the light receiving portion and the display portion so as to guide the light received by the receiving portion to the display portion. The supporting member at least partly functions as the light guide portion. The light receiving portion is located, with a gap with respect to the light emitting portion, so as to cover the light emitting portion. The light receiving portion approaches the light emitting portion when the supporting member approaches the ink containing body by being subjected to urging toward the ink containing body.

27 Claims, 10 Drawing Sheets

(56) References Cited

U.S. PATENT DOCUMENTS

| | | | | |
|---|---|---|---|---|
| 2007/0268325 | A1* | 11/2007 | Watanabe | 347/19 |
| 2008/0151023 | A1 | 6/2008 | Kotaki et al. | 347/86 |
| 2008/0204529 | A1 | 8/2008 | Matsumoto et al. | 347/86 |
| 2008/0211892 | A1 | 9/2008 | Kotaki et al. | 347/86 |
| 2009/0122092 | A1 | 5/2009 | Hatasa et al. | 347/7 |

FOREIGN PATENT DOCUMENTS

| | | | |
|---|---|---|---|
| JP | 2006-116785 | | 5/2006 |
| JP | 2006-116787 | | 5/2006 |
| JP | 2006-142484 | | 6/2006 |
| JP | 2006-142796 | | 6/2006 |
| JP | 2007-001212 | | 1/2007 |
| JP | 2007001212 | A * | 1/2007 |
| JP | 2007-112150 | | 5/2007 |
| JP | 2013018160 | A * | 1/2013 |
| RE | 2337829 | | 11/2008 |
| WO | 2006/043718 | | 4/2006 |

OTHER PUBLICATIONS

Extended European Search Report dated Feb. 14, 2011 from corresponding European Application No. 10193598.9.

European Search Report dated Jul. 15, 2009, from corresponding European Application No. 09156657.0.

Extended European Search Report dated Feb. 25, 2013 in counterpart European Application No. 12179152.9.

Russian Decision on Grant from corresponding Russian Application No. 2009111714/12(015980), and English language translation thereof , dated Sep. 27, 2010.

* cited by examiner (a)

(b)

INK JET RECORDING SYSTEM AND INK CONTAINER COMPRISING A LIGHT EMITTING PORTION

FIELD OF THE INVENTION AND RELATED ART

The present invention relates to an ink container and an ink jet recording system. Specifically, the present invention relates to an ink container and an ink jet recording system which employ a constitution for efficiently guiding light, emitted from a light emitting member such as an LED provided to the ink container, to an operating portion(display portion) of a lever for operation.

In recent years, which widespread use of digital imaging equipment such as digital camera (hereinafter referred to as "digital equipment"), such a style that data transmission is performed by directly connecting the digital equipment with a printer or directly mounting a recording medium for the digital equipment such as a memory card in the printer without through a personal computer (PC) to effect recording, i.e., so-called non-PC recording, is increasing.

With respect to an ink container mountable to the printer used in such an environment, in order to improve handleability thereof by a user, e.g., a technique disclosed in Japanese Laid-Open Patent Application (JP-A) 2006-142484 is employed. In the technique, the light emitting member such as LED (hereinafter referred to as "LED" or "light emitting portion") is disposed with respect to the ink container so that the user can confirm a state of the ink container mounted on the printer by visual observation. JP-A 2006-142484 discloses, as one of embodiments, utilization of light emission at the light emitting portion as a means for transmitting a state of the ink container to the user.

Further, such a constitution that light from the light emitting portion disposed with respect to the ink container is guided to a position different from a position in which the light emitting portion is disposed is proposed. For example, JP-A 2006-142796 discloses a constitution for guiding light emitted from an LED to a desired position in the case where a position in which the LED is disposed is restricted. In JP-A 2006-142796, such a constitution that a light receiving portion for receiving the light from the LED is disposed to face the LED and a light guide member for guiding the received light to a display portion for outputting the light to effect display is disclosed. The light guide member disclosed in JP-A 2006-142796 is provided to the ink container as an independent structure.

As the constitution of the light guide member, in addition to the above-described independent structure, such a constitution that an operating lever itself utilized for mounting the ink container is used so that an operating portion of the operating lever is used as a display portion is disclosed in JP-A 2006-116785.

Further, JP-A 2007-1212 discloses such a constitution that a substrate to which a light emitting portion is provided is equipped with a light guide member as a unit and the unit is disposed with respect to an ink container. JP-A 2007-1212 also discloses a constitution in which a light display portion is used as an operating portion of an operating lever and the operating lever connecting a light receiving portion with the display portion is utilized as the light guide member.

By using the light guide member as described above, it is possible to determine disposition (arrangement) of the light emitting portion and the display portion with a certain degree of design latitude. Further, such a light guide member is constituted to cover the light emitting portion, so that the light from the light emitting portion can be transmitted to the display portion while retaining a sufficient amount of light (light amount).

In either of the above-described constitutions disclosed in JP-A 2006-142484, JP-A 2006-142796, JP-A 2006-116785 and JP-A 2007-1212, the LED as the light emitting portion and the light receiving portion are disposed with a certain gap (spacing). Intensity of light outputted from the display portion, i.e., the light amount varies depending on a distance between the LED as the light emitting member and the light receiving portion of the light guide member in the case where the materials constituting the light guide member are the same.

Here, a relationship between the amount of light entering the light receiving portion and the distance between the light receiving portion and the LED (light emitting portion) will be described with reference to FIGS. 10(*a*) and 10(*b*) which are schematic views. FIG. 10(*a*) shows a constitution in which a light emitting portion 51*a* for isotropically emitting light in a planar shape is disposed and a light receiving portion 33*a* of the light guide member 36 is disposed with a distance r from the light emitting portion 51*a*. An amount of light, of light emitted from the light emitting portion 51*a*, received by the light receiving portion 33*a* is represented by $Sa/4\pi r^2$ where Sa represents an area of the light receiving portion 33*a*. On the other hand, FIG. 10(*b*) shows a constitution in which the light receiving portion 33*a* placed in the state shown in FIG. 10(*a*) has approached a position with a distance ½ from the light emitting portion 51*a*. In this case, an amount of light reaching the light receiving portion 33*a* is represented by $Sa/4\pi r(1/2)^2$. That is, the amount of the light reaching the light receiving portion 33*a* is inversely proportional to the square of the distance r, so that the amount of the light received by the light receiving portion is increased by decreasing the distance between the light emitting portion and the light receiving portion. When the light guide member 36 is under the same condition, the amount of the light guided to the display portion is increased with a shorter (decreased) distance between the light emitting portion and the light receiving portion.

That is, when the distance between the light emitting portion and the light receiving portion is large, the light from the light emitting portion cannot be sufficiently guided to the display portion, with the result that the light amount at the display portion is insufficient in some cases. On the other hand, it is easily conceivable that the light emitting portion and the light receiving portion are disposed so that the light receiving portion for receiving light from the light emitting portion is brought near to the light emitting portion as close as possible for the purpose of ensuring the light amount. From this viewpoint, e.g., as disclosed in JP-A 2006-142796, such a constitution that the substrate provided with the light emitting portion is disposed with respect to the ink container and the light receiving portion of the light guide member is disposed at a position opposite to the light emitting portion is employed as a preferred constitutional embodiment.

However, in the case where the amount of the received light is intended to be increased by disposing the light emitting portion and the light receiving portion of the light guide member so as to be closer to each other, it is necessary to constitute the light guide member with high accuracy. Failure to do so may cause breakage of the light emitting portion due to excessive approach of the light receiving portion of the light guide member to the light emitting portion, when the light emitting portion is attached to the ink container, resulting in contact between the light emitting portion and the light receiving portion. Incidentally, when the LED and the light receiving portion are configured to keep a manufacturing safety distance in order to obviate such a situation, there is a possibility that the light emitting portion and the light receiving portion are moved apart from each other, thus failing to provide an expected light amount.

Further, even in the case where the light emitting portion is manufactured with high accuracy and is attached to the ink container safety, there is also a possibility that such an unexpected situation that the attached light emitting portion and the light receiving portion of the light guide member contact each other to break the LED due to an impact or the like caused, e.g., in the case of falling of the ink container during transportation or the like occurs. When various factors such as safety and manufacturing easiness are taken into consideration, the light emitting portion and the light receiving portion cannot be disposed excessively closely to each other. That is, ensuring of the light amount and protection of the LED have a trade-off relationship.

As another means for increasing the amount of light received by the light receiving portion, the light guide member may be formed in a large thickness to increase an area of the light receiving portion. For example, as disclosed in JP-A 2007-1212, in the case where a substrate unit provided with the light emitting portion and the light guide member is disposed in the neighborhood of a supporting point portion of an operating lever to constitute a display portion, the neighborhood of the supporting point portion of the light, itself constitutes an optical path(see, e.g., FIG. 10 of JP-A 2007-1212). In the case, the thickness of the supporting point portion of the operating lever is increased to result in an increased operating force of the lever. Further, in the neighborhood of the supporting point portion of the operating lever constituted to have the large thickness, the supporting point portion is deformed to become white in some cases, so that a light-guiding property can be lowered by the deformation. In this regard, there is a possibility that the white deformation at the supporting point portion of the operating lever occurs similarly in the constitution disposed in JP-A 2006-116785.

SUMMARY OF THE INVENTION

A principal object of the present invention is to provide an ink container, for notifying a user of a state of an ink container by utilizing light emission from a light emitting portion such as an LED, capable of realizing not only such a constitution that a sufficient amount of light can be transmitted to a display portion with a simple structure without risking the above-described possibilities but also good protection of the light emitting portion such as the LED while avoiding risks which can occur during manufacturing, transportation, or the like.

Another object of the present invention is to provide an ink jet recording system capable of effectively utilizing such an ink container.

The present invention has been accomplished by focusing attention on such a point that a supporting member which is provided to the ink container and constitutes an operating lever utilized when the ink container is mounted and fixed to a holder is displaced before and after the mounting of the ink container to the holder.

That is, by utilizing the displacement of the supporting member so as to approach the ink container by the mounting of the ink container to the holder, when a light guide member is provided to the supporting member, a light receiving portion of the light guide member is constituted so that the light receiving portion relatively moves apart from the LED in a state before the light receiving portion of the light guide member is mounted and relatively approaches the LED by the mounting thereof.

According to an aspect of the present invention, there is provided an ink container for retaining ink, comprising:

an ink containing body;

an elastically displaceable supporting member;

a light emitting portion;

a light receiving portion for receiving light from the light emitting portion;

a display portion for displaying the received light; and a light guide portion for optically connecting the light receiving portion and the display portion so as to guide the light received by the receiving portion to the display portion, wherein the supporting member at least partly functions as the light guide portion, wherein the light receiving portion is located, with a gap with respect to the light emitting portion, so as to cover the light emitting portion, wherein the light receiving portion approaches the light emitting portion when the supporting member approaches the ink containing body by being subjected to urging toward the ink containing body, and wherein the light receiving portion moves apart from the light emitting portion when the supporting member moves apart from the ink containing body by being released from the urging toward the ink containing body.

According to another aspect of the present invention, there is provided an ink container for retaining ink, comprising:

an ink containing body;

an elastically displaceable supporting member;

a light emitting portion;

a light receiving portion for receiving light from said light emitting portion; and a display portion for displaying the received light, wherein said light guide portion is provided with a light guide portion for optically connecting said light receiving portion and said display portion so as to guide the light received by said receiving portion to said display portion, wherein said light receiving portion is located, with a gap with respect to said light emitting portion, so as to cover said light emitting portion, wherein said light receiving portion approaches said light emitting portion when said supporting member approaches said ink containing body by being subjected to urging toward said ink containing body, and wherein said light receiving portion moves apart from said light emitting portion when said supporting member moves apart from said ink containing body by being released from the urging toward said ink containing body.

According to a further aspect of the present invention, there is provided an ink jet recording system for effecting recording by ejecting ink from a recording head, comprising:

an ink container;

a recording head for ejecting ink supplied from the ink container; and a holder to which the ink container is mountable, wherein the ink container comprises an ink containing body, a light emitting portion, a light guide portion for receiving light from the light emitting portion and guiding the received light to a display portion, and a supporting member which is provided with the light guide portion and is displaceable by being mounted to the holder, and wherein the light receiving portion approaches the light emitting portion by displacement of the supporting member toward the ink containing body caused by mounting of the ink container to the holder.

According to a still further aspect of the present invention, there is provided an ink jet recording system for effecting recording by ejecting ink from a recording head, comprising:

an ink container;

a recording head for ejecting ink supplied from said ink container; and a holder to which said ink container is mountable, wherein said ink container comprises an ink containing body, a light emitting portion, a light guide portion for receiving light from the light emitting portion and guiding the received light to a display portion, and a supporting member which at least partly functions as the light guide portion and is displaceable by being mounted to the holder, and wherein the light receiving portion approaches said light emitting portion by displacement of said supporting member toward said ink containing body caused by mounting of said ink container to the holder.

According to the above-described constitution, before the ink container is mounted to the holder, the ink container and the supporting member relatively move apart from each other, so that the light receiving portion of the light guide member provided to the supporting member is located apart from the LED or the like constituting the light emitting portion. When the ink container is mounted to the holder, the supporting member approaches the ink container. At the same time, the light receiving portion of the light guide member approaches the light emitting portion. As a result, when the supporting member is configured to relatively move apart from the ink container, e.g., during ink container manufacturing, the light receiving portion of the light guide member is also located apart from the LED, so that it is possible to reduce a degree of dangerousness such as breakage during assembling of a substrate provided with the LED. Further, when the ink container is mounted to the holder, the light receiving portion of the light guide member approaches the LED with displacement of the supporting member, so that most of light from the light emitting portion can be caused to enter the light receiving portion and therefore it is possible to ensure a large value as an amount of light outputted at the display portion.

Further, also by an impact unnecessarily exerted on the ink container, such as falling, during handling of the ink container before the ink container is mounted to the holder, the LED as the light emitting portion and the light receiving portion of the light guide member are placed in a mutually separated state, so that the LED and the light receiving portion less contact each other and particularly it is possible to prevent damage of the light emitting portion. Further, the LED as the light emitting portion and the light receiving portion of the light guide member are configured so as to ensure the mutually separated state when the supporting member is displaced at a maximum level, so that reliability with respect to protection of the LED from an external impact is further improved.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

(First Embodiment)

Figure 1:
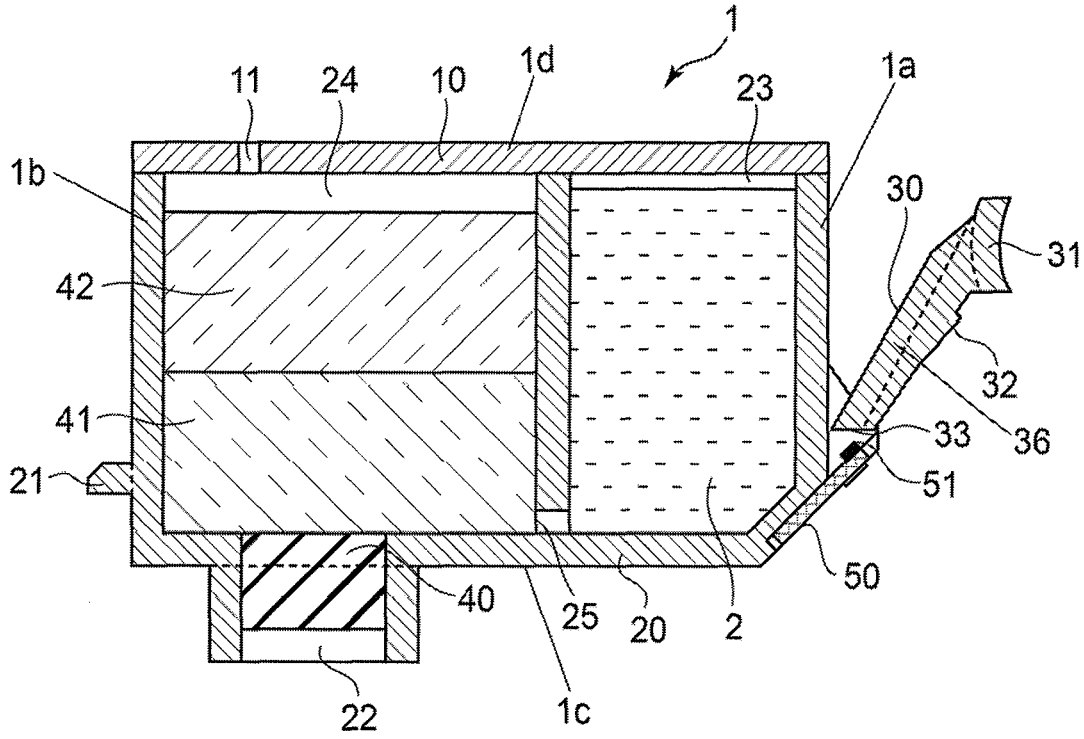
FIG. 1 is a sectional view, showing an ink container according to an embodiment of the present invention, taken along A-A line indicated in FIG. 2(*d*).
Figure 3:
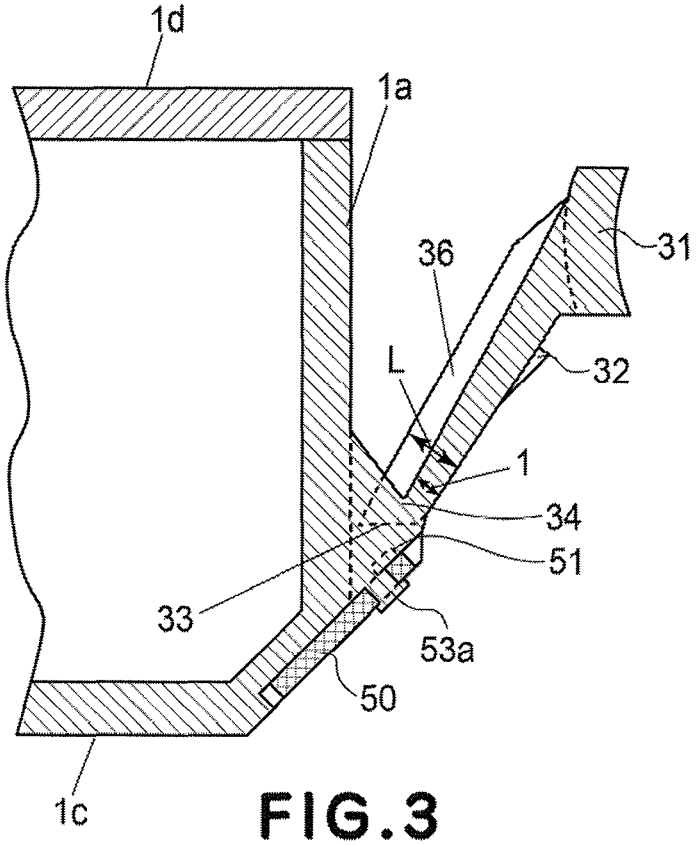
FIG. 3 is a sectional view, showing the ink container according to the embodiment of the present invention, taken along B-B line indicated in FIG. 2(*d*).
Figure 2:
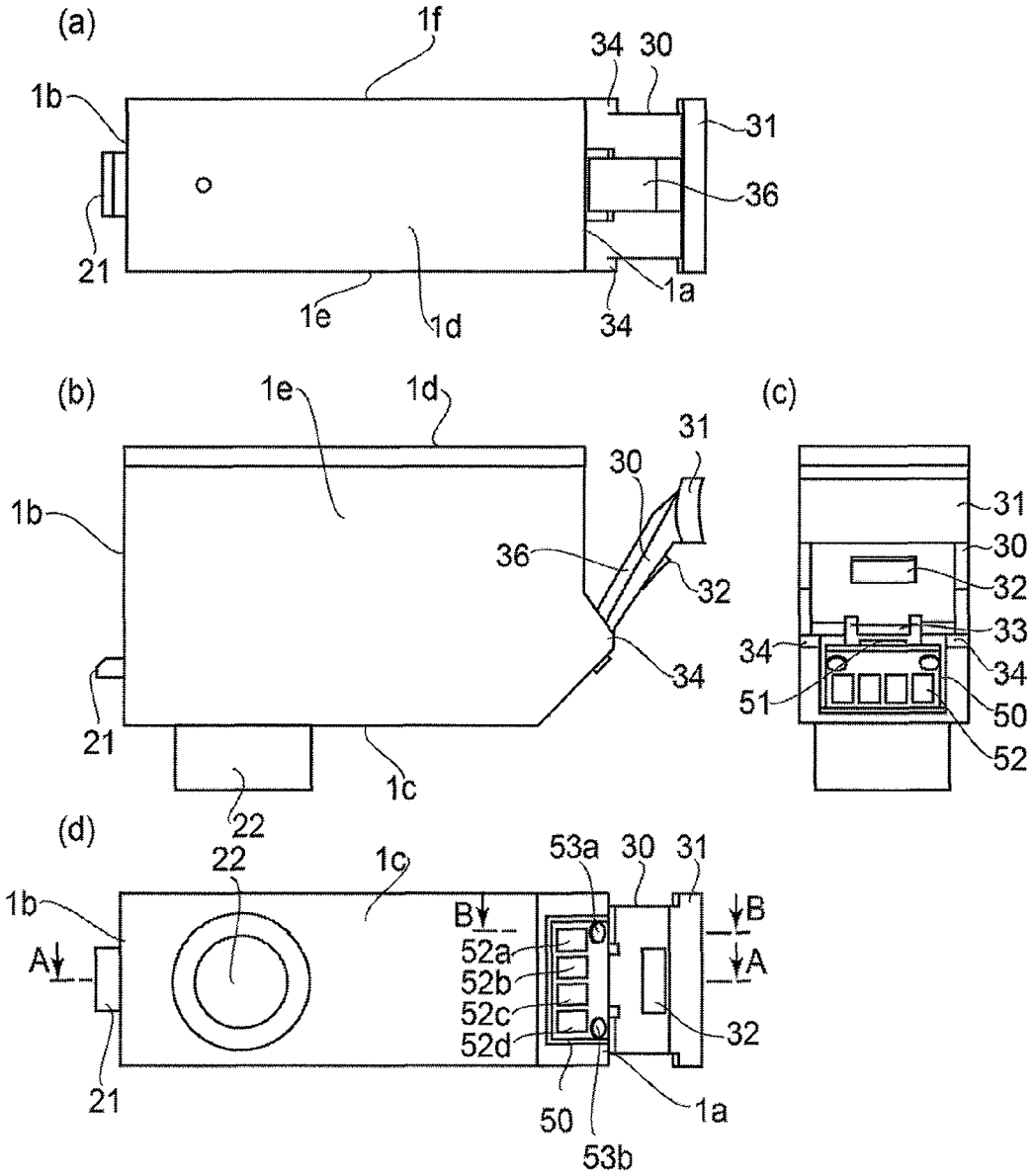
FIGS. 2(*a*), 2(*b*), 2(*c*), and 2(*d*) are a top plan view, a side view, a front view, and a bottom view, respectively, showing the ink container according to the embodiment of the present invention.

FIG. 1, FIGS. 2(*a*) to 2(*d*), and FIG. 3 are views showing a schematic structure of an ink container according to First Embodiment of the present invention. FIG. 1 is a sectional side view taken along A-A line indicated in FIG. 2(*d*) and FIG. 3 is a sectional side view taken along B-B line indicated in FIG. 2(*d*). FIGS. 2(*a*), 2(*b*), 2(*c*), and 2(*d*) are a top plan view, a side view, a front view, and a bottom view, respectively, of the ink container. Herein, a front surface (side) of the ink container is a surface (side) which is faced to the user who is manipulating the ink container (mounting and demounting operation of the ink container), which provides the user with information (by light emission of LED which will be described hereinafter).

In FIG. 1, an ink container 1 is constituted by being provided with, as principal surfaces, a front surface la provided with an operating lever 30 utilized for the mounting and demounting operation of the ink container (hereinafter referred to as a "supporting member"), a rear surface 1*b* opposite from the front surface 1*a*, a bottom surface 1*c* provided with an ink supply port (also referred to as a "lower surface" as a matter of convenience), a top (or upper) surface 1*d*, and two side surfaces 1*e* and 1*f* connecting these surfaces. The supporting member 30 is made of resin material integrally molded with an outer casing member of the ink container 1, and a portion 34 integrally connected with the outer casing member is supporting point portion during displacement. The ink container 1 is provided on its rear surface 1*b* side and front surface 1*a* side with a first engaging portion 21 and second engaging portion 32, respectively, which are engageable with locking portions provided on an ink container holder 150 side which will be described hereinafter. By engagement of the engaging portion 21 and the engaging portion 32 with the locking portions, a mounted state of the ink container 1 in the ink container holder 150 is ensured. In this embodiment, the second engaging portion 32 is integrally molded with the supporting member 30 as part of the supporting member 30. The operation during the mounting will be described hereinafter referring to FIG. 15.

The bottom surface 1*c* of the ink container 1 is provided with an ink supply port 22 for ink supply, which port is connectable with an ink introduction opening of a recording head which will be described hereinafter, by mounting of the ink container 1 to the ink container holder 150. A substrate 50 is provided in an inclined state on the bottom surface 1*c* side of the supporting point portion 34 of the supporting member 30 as a portion for connecting bottom surface 1*c* side and the front surface 1*a* side. On the substrate 50, a light emitting portion such as the LED is disposed as described later.

An inside of the ink container 1 is divided into an ink reservoir chamber 23 which is provided adjacent the front surface side, and an absorbing member accommodating chamber 24 which is provided adjacent the rear surface side and which his in fluid communication with the ink supply port 22. These chambers 23 and 24 are in fluid communication with each other through a communication port 25. The ink reservoir chamber 23 directly contains ink 2, whereas the absorbing member accommodating chamber 24 is provided with an (ink) absorbing material (e.g., fibrous absorbing members 41 and 42 using a porous member made of sponge, fibers or the like) for retaining the ink by impregnation. The absorbing members 41 and 42 generate a proper negative pressure in a range in which the pressure is sufficient to provide balance with the force of meniscus formed in an ink ejection nozzle portion of the recording head to prevent ink leakage from the ink ejection portion to the outside and to permit an ink ejection operation of the recording head.

On the top surface of the absorbing member accommodating chamber 24, an ambient air communication portion 11 for establishing communication of the absorbing member accommodating chamber 24 with ambient air is provided, so that the ambient air is introduced so as to relax the negative pressure increased by supply of the ink to the recording head and thus the negative pressure can be kept in a preferable pressure range.

The internal structure of the ink container 1 is not limited to such a partitioned structure in which the inside is partitioned into the absorbing member accommodating chamber and the reservoir chamber containing the ink alone but may also be any structure. For example, the absorbing member may be filled in substantially all of the inside space of the ink container. As a negative pressure generating means, the ink alone may be contained in a bladder-like member made of elastic material such as rubber or the like which produces tension in a direction of expanding the volume thereof, and the negative pressure is caused to act on the inside ink by the tension generated by the bladder-like member. Further, at least a part of the ink accommodation space may be constituted by a flexible member, and the ink is accommodated in the space, wherein a spring force is applied to the flexible member, by which a negative pressure is generated. It is possible to use the ink container having a constitution used in the field of normal ink jet recording.

The substrate 50 is, as shown in FIG. 2(*d*), provided with electrode pads 52*a* to 52*d* which are disposed on a surface facing the outside of the ink container and permit electrical connection with a recording apparatus. On the other hand, as shown in FIG. 1, on the surface directed toward the inside of the ink container 1, a light emitting portion 51 for emitting visible light such as LED (hereinafter referred to as "LED" as a matter of convenience) and a control element (not shown) for controlling the light emission of the LED 51 are provided, so that the control element effects the light emission control of the LED 51 by an electric signal supplied through the electrode pads 52. The substrate 50 is also provided with a memory element on the same surface side as that where the LED 51 is provided. In this memory element, information on the color (type) of the ink contained in the ink container and a remaining ink amount based on a counted value of the number of ejection operations is stored. The substrate 50 is, as shown in FIG. 2(*d*), fixed to the outer casing member of the ink container by fixing members 53*a* and 53*b*. In this embodiment, the fixing members 53*a* and 53*b* are a pin-like member and are engaged in holes provided to the substrate 50 and then end portions of the fixing members 53*a* and 53*b* are swaged by thermo-fusion (melting) to be fixed. The fixing method is not limited to the above method but may also be performed by bonding, fitting, or the like.

In this fixed state, the LED 51 is, particularly as shown in FIG. 1, disposed on the substrate 50 close to the supporting member 30. In this embodiment, as shown in FIGS. 1 and 3, above the LED 51 disposed on the substrate 50, a casing of the ink container is constituted so as not to be covered. Further, above the LED 51, as shown in FIG. 1, a base portion of the supporting member 30 is extended so as to cover over the LED 51 with a certain distance from the LED 51. The extended portion over the LED 51 constitutes a light receiving portion 33 for receiving light emitted from the LED 51. Then, the light received by the light receiving portion 33 is outputted from an operating portion 31 (constituting a display portion), and a portion connecting the light receiving portion 33 and the operating portion 31 constitutes a light guide portion 36. The supporting member 36 is, particularly as shown in FIGS. 2(*b*) and 3, connected with the outer casing member of the ink container at two supporting point portions 34 located on both sides of the base portion of the supporting member 30. A central portion of the base portion of the supporting member 30 except for these supporting point portions is protruded, so that a part of an inner wall surface of the protruded portion constitutes the light receiving portion 36.

As shown in FIG. 3, with respect to the supporting member 30, when a thickness of a portion corresponding to the light receiving portion 33 and its extended portion is taken as L and a thickness of a portion corresponding to the supporting point portion 34 is taken as l, L >l is satisfied, so that the thicknesses are different from each other. Particularly, as shown in FIGS. 1 and 3, the supporting member 30 is formed thickly at the central portion (a lower surface of which constitutes the light receiving portion covering the LED as described above) and thinly at both side portions corresponding to the supporting point portions 34. The thick central portion of the supporting member 30 functions as the light guide portion 36 for guiding the light received by the light receiving portion 33 to the display portion as described above.

The supporting member 30 can be displaced by being deformed in the neighborhood of the supporting point portions 34 when the ink container is mounted to the holder. At this time, as described above, the thickness of the supporting point portions 34 located at the both side portions is configured to be small, so that a force for displacing the supporting member 30 by a user is reduced and thus it is possible to ensure facility of mounting and demounting of the ink container.

Figure 4:
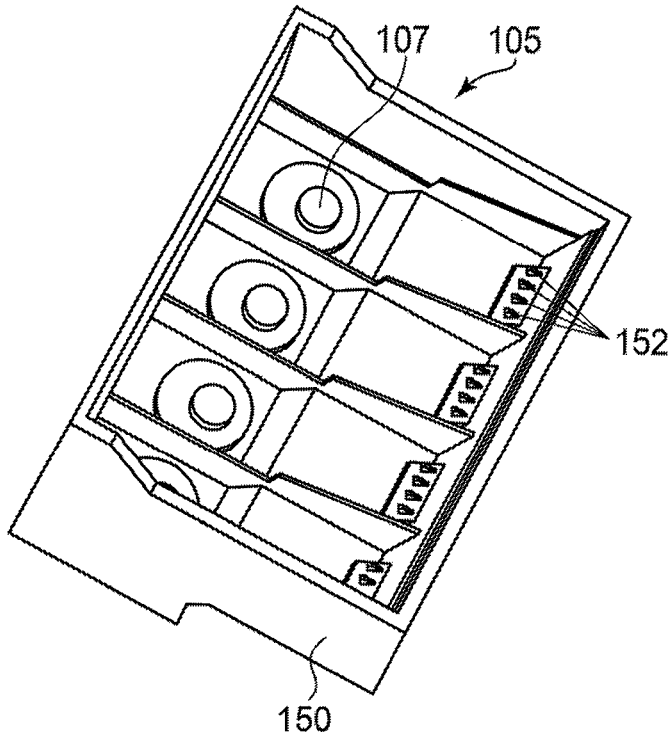
FIG. 4 is a perspective view showing an example of a recording head unit for holding the ink container according to the embodiment of the present invention in a detachably mountable manner.
Figure 5:
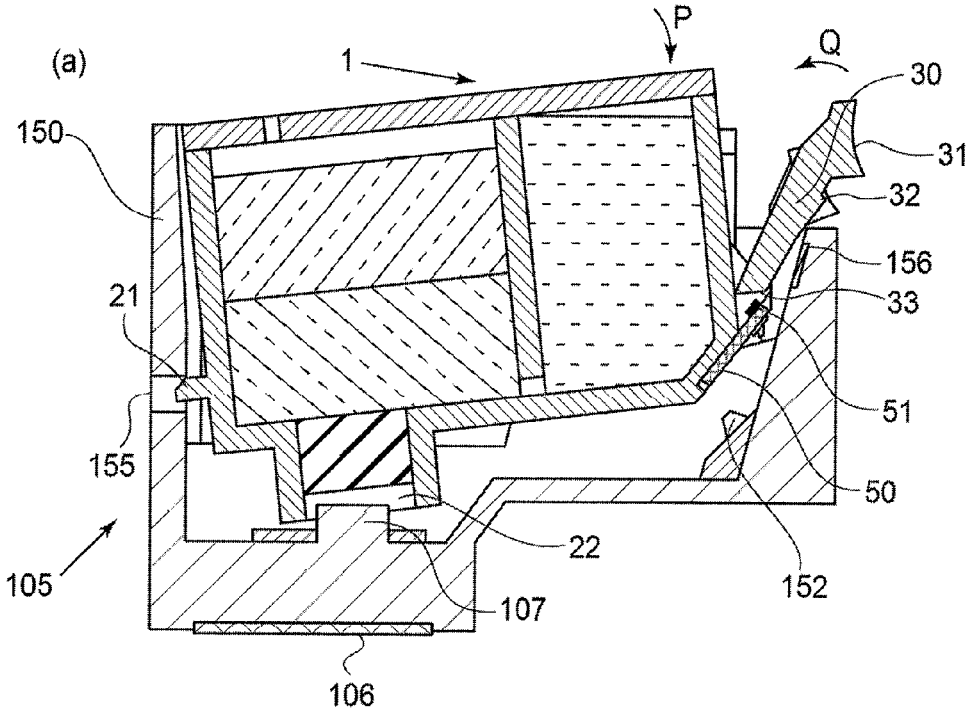
FIG. 5(*a*) is a sectional view for illustrating a state of an ink container according to First Embodiment of the present invention before the ink container is mounted, and FIG. 5(*b*) is a perspective view showing the state.
Figure 5:
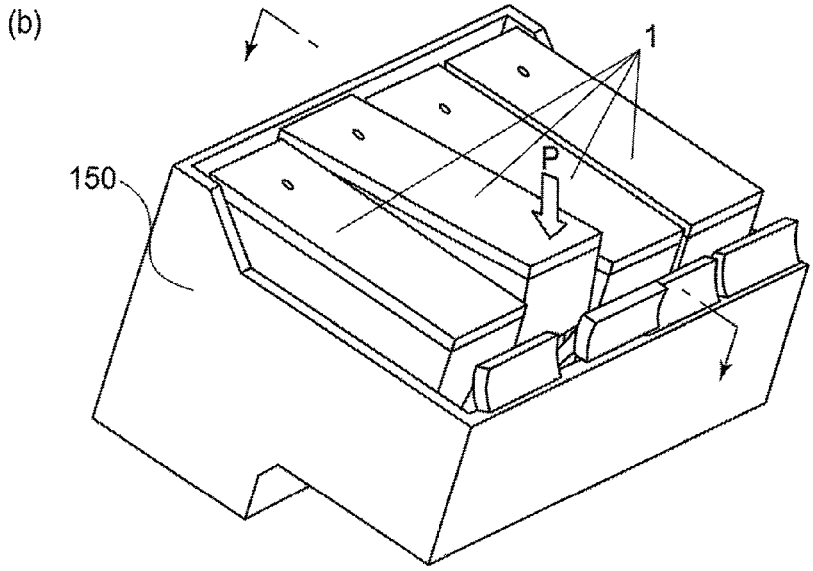

FIG. 4 is a perspective view showing an example of a recording head unit 105 for holding the ink container shown in FIGS. 1 to 3 in a detachably mountable manner. FIGS. 5(*a*) and 5(*b*) are schematic views for illustrating a state immediately before the ink container 1 is mounted to the recording head unit 105, and FIGS. 6(*a*) and 6(*b*) are schematic views for illustrating a state in which the ink container 1 is mounted to the recording head unit 105.

The recording head unit 105 is generally constituted by a holder 150 for detachably and mountably holding a plurality (four in FIG. 4) of ink containers, and a recording head 106 disposed adjacent the bottom surface side (unshown in FIG. 4 but shown in FIG. 5(*a*)). By mounting the ink container 1 to the holder 150, an ink introduction opening 107 of the recording head disposed adjacent the bottom surface portion of the holder is connected with the ink supply port 22 of the ink container to establish an ink communication path therebetween.

An example of the recording head 105 comprises a liquid passage constituting a nozzle and an electrothermal transducer element provided in the liquid passage. To the electrothermal transducer element, electrical pulses constituting recording signals are supplied, thus applying thermal energy to the ink. By pressure during bubble generation (boiling) caused by a phase change of the ink at that time, the ink is ejected.

When the ink container 1 is mounted to the recording head unit 105, the holder 150 is handled above the holder 150. That is as shown in FIG. 5(*a*), a first engaging portion 21 in the form of a projection provided on an ink container rear surface lb side is inserted into a first locking portion 155 in the form of a through hole provided in a holder rear surface side, and in this state, the ink container 1 is placed on the bottom surface of the holder. The resultant state is shown in FIG. 5(*b*) as a perspective view. The ink container is in an unmounted state and thus is illustrated in a raising state. In this state, when the front side upper end of the ink container 1 is pressed down as indicated by an arrow P, the ink container 1 rotates about the engaging portion between the first engaging portion 21 and the first locking portion 155 of the holder as a rotational fulcrum, so that front side of the ink container is displaced downwardly. In the process of this action, the supporting member 30 is displaced in the direction of an arrow Q, while a side surface of a second engaging portion 32 provided in the supporting member 30 on the ink container front side is being pressed to a wall provided on the holder front side. That is, the supporting member 30 is rotationally displaced about the supporting point portions 34.

Figure 6:
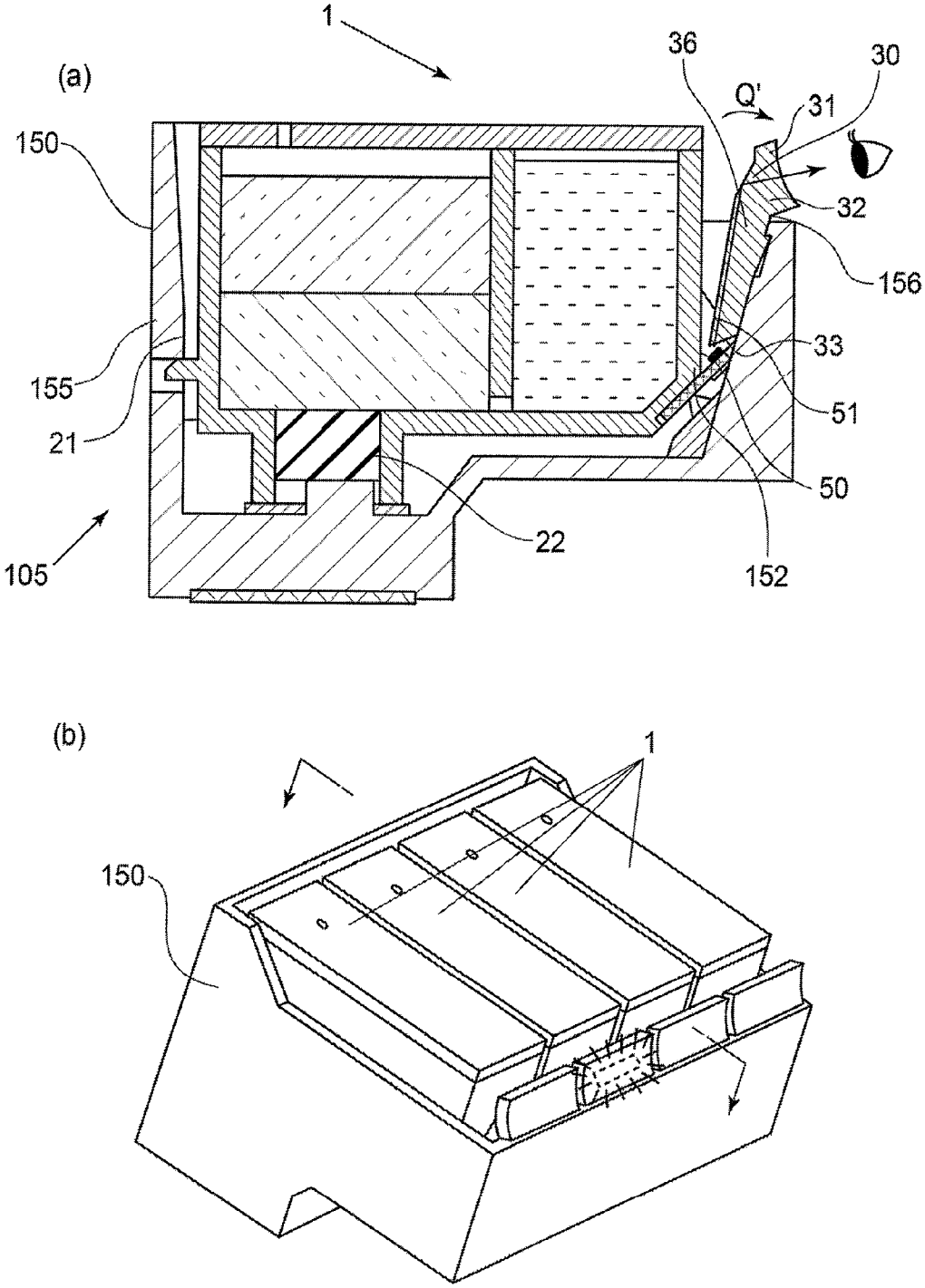
FIG. 6(*a*) is a sectional side view for illustrating a state of completion of the mounting of the ink container according to First Embodiment of the present invention, and FIG. 6(*b*) is a perspective view showing the state.

In the ink container mounting, then, the pressing down by the user in the direction of the arrow P is completed when the top surface of the second engaging portion 32 reaches a portion located below the second locking portion 156. The supporting member 30 is displaced in a direction of an arrow Q' opposite to the direction of the arrow Q by the elastic force of the supporting member 30, so that second engaging portion 32 is locked with the second locking portion 156. This state is shown in FIGS. 6(*a*) and 6(*b*). The upward displacement of the ink container 1 is suppressed by the first locking portion 155 engaged with the first engaging portion 21 and by the second locking portion 156 engaged with the second engaging portion 32. This state is a mounting completion state of the ink container 1, wherein the ink supply port 22 is connected with the ink introduction opening 107, and the electrode pads 52 are electrically connected with the connector 152. In this state, the ink supply port 22 is pressed against the ink introduction opening 107 with a large force by the rotation of the ink container 1. At the connecting portion between these port and opening, an elastic member such as a filter, an absorbing material, a packing or the like is provided for the purposes of assuring an ink communication property and preventing ink leakage there.

In the ink container mounting completion state, the first locking portion 155 engaged with the first engaging portion 21 and the second locking portion 156 engaged with the second engaging portion 32 prevent the ink container 1 from rising away from the holder. Therefore, the restoration of the elastic member is suppressed, and the member is kept in an appropriately elastically deformed state. On the other hand, the electrode pads 52 and connectors 152 which constitute electrical contacts are made of a relative high rigidity electroconductive material such as metal to ensure a good electrical connection property therebetween. Then, the mounting of the ink container 1 is completed, the LED 51 can emit light in a state in which the electrode pads 52 of the substrate 50 and the connectors 152 are electrically connected with each other.

In this state, as shown in FIG. 6(*a*), the supporting member 30 is displaced toward the ink container side compared with a state before the mounting of the ink container 1, so that the light receiving portion 33 is displaced toward the LED 51 side. As a result, a distance between the light receiving portion 33 and the LED 51 is shorter than that before the ink container mounting. As a result, the light from the LED 51 can be taken in the light receiving portion 33 in a larger amount. The light taken in the light receiving portion 33 passes through the thick portion (LGP) 36, of the supporting member 30, provided correspondingly to the light receiving portion 33 and reaches the operating portion 31 (display portion). FIG. 6(*b*) schematically shows a light emission state. The user can recognize information on the ink container such as a remaining ink amount or an ink container-mounted state.

As described above, according to this embodiment of the present invention, by employing such a constitution that the portion at one end surface of the supporting member is constituted as the light receiving portion and is opposite to the light emitting portion, the light receiving portion is displaceable so that the light receiving portion can approach the light emitting portion side by the mounting operation of the ink container. As a result, most of the light from the light emitting portion can be caused to enter the light receiving portion, so that it is possible to transmit a sufficient amount of the light without using a separate member such as the light guide member different from the supporting member.

Figure 7:
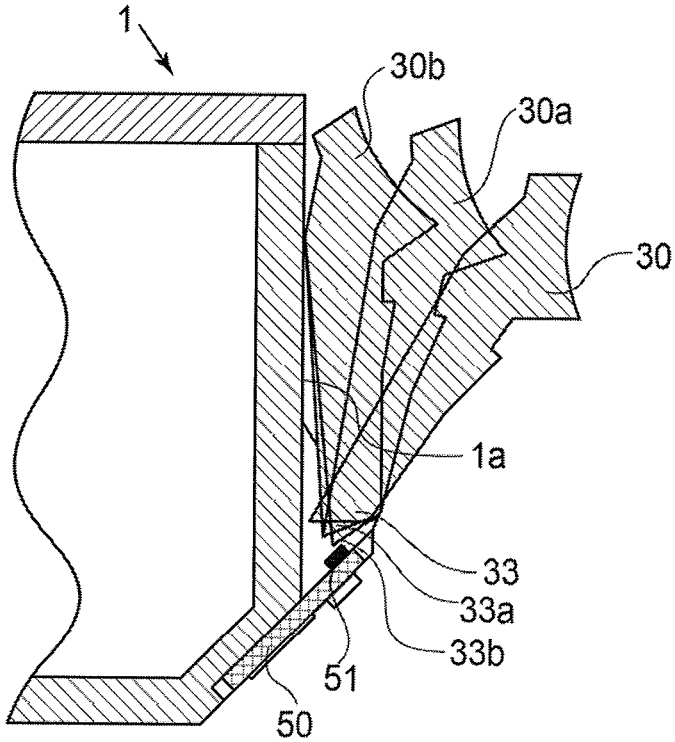
FIG. 7 is a schematic view for illustrating a state of displacement of a supporting member.

Incidentally, the supporting member 30 descried in this embodiment is constituted so as not to break the LED 51 even in the case where the supporting member 30 is displaced toward the front surface la of the ink container 1 at a maximum level. FIG. 7 is a partially enlarged schematic view showing the supporting member 30 of the ink container 1 and its peripheral portion and showing displacement states of the supporting member 30. The supporting member 30 in a normal state is located at a position in which the light receiving portion 33 is most distant from the LED 51. For that reason, in an operation for incorporating the substrate 50 provided with the LED 51 into the ink container, it is possible to avoid such a possibility that the light receiving portion 33 and the LED 51 contact each other to cause breakage. When the ink container is mounted to the holder, the supporting member is displaced to a mounted state position in which the supporting member is indicated as a supporting member 30*a*. At this time, the light receiving portion is placed in a state in which the light receiving portion approaches the LED (i.e., a light receiving portion 33*a*). In this state, the light receiving portion 33*a* can effectively receive the light from the LED to guide the light to the display portion. The supporting member in a state in which the supporting member is displaced toward the ink container side at a maximum level is indicated as a supporting member 30*b*, e.g., in the case where the ink container falls during handling. Also in this case, the surface of the light receiving portion 33 is constituted so that the light receiving portion 33 does not contact the LED 51 and the supporting member 30 is constituted so that part of the supporting member 30 contacts the ink container 1 before the light receiving portion 33 contacts the LED 51.

By employing the constitution as described above, handleability of the ink container 1 can be easily realized with high reliability.

Further, the supporting point portions at which the supporting member and the outer casing member of the ink container are connected with each other are portions other than the light receiving portion constituting a spacing therebetween and are formed in a thickness less than that of the light receiving portion. As a result, it is possible to suppress an increase in force for displacing the supporting member by the ink container mounting while a portion corresponding to the light receiving portion is provided in a desired thickness.

In the above-described embodiment, particularly, the ink container provided with the first engaging portion 21 is described but the ink container to which the present invention is applicable is not necessarily required to be provided with such a constitution. This is because, even in the case of no engaging portion 21, e.g., the ink container can be mounted while part of the ink container on the rear surface side contacts a mounting portion of the ink container holder or the like during the ink container mounting and then the contact portion is moved.

(Second Embodiment)

Figure 8:
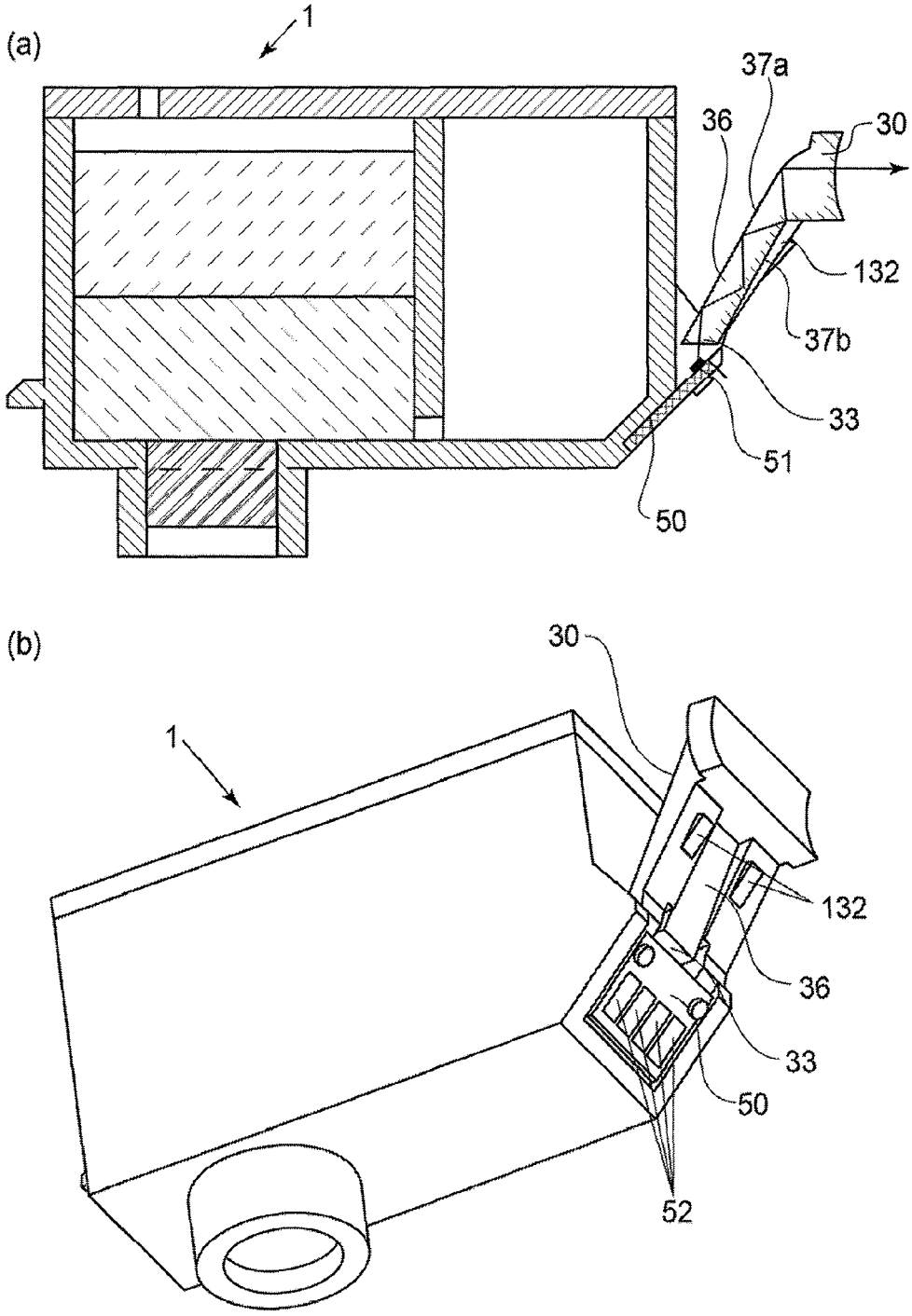
FIG. 8(*a*) is a sectional view for illustrating Second Embodiment, and FIG. 8(*b*) is a perspective view for illustrating Second Embodiment.

FIGS. 8(*a*) and 8(*b*) illustrate Second Embodiment.

Second Embodiment is identical to First Embodiment except that a constitution of a second engaging portion 132 is different from the second engaging portion 32 in First Embodiment as shown in FIG. 8(*a*). In First Embodiment, the second engaging portion 32 is described as such a constitution that a single second engaging portion 32 is provided at a central portion of the supporting member. On the other hand, in Second Embodiment, such a constitution that two second engaging portions 132 are provided on both end sides avoiding the central portion is employed.

In the case of First Embodiment, the projection constituting the second engaging portion is present at the central portion constituting the light guide portion of the supporting member and therefore reflection of the light guided through the light guide portion is disturbed at the portion, so that there is a possibility of attenuation of the amount of light reaching the display portion. The constitution in which such an attenuation of the light amount due to the disturbance in the light reflection is suppressed is employed in Second Embodiment.

As shown in FIG. 8(*b*), by deviating the projections constituting the second engaging portions 132 from a reflection path of the light at the light guide portion 36 of the supporting member 30, a reflection surface 37*a* and a reflection surface 37*b* which are located at the central portion constituting the light guide portion 36 of the supporting member 30 can be constituted as parallel surfaces, so that unnecessary disturbance in reflection can be eliminated to provide a constitution for transmitting the light with a high degree of efficiency.

(Third Embodiment)

Figure 9:
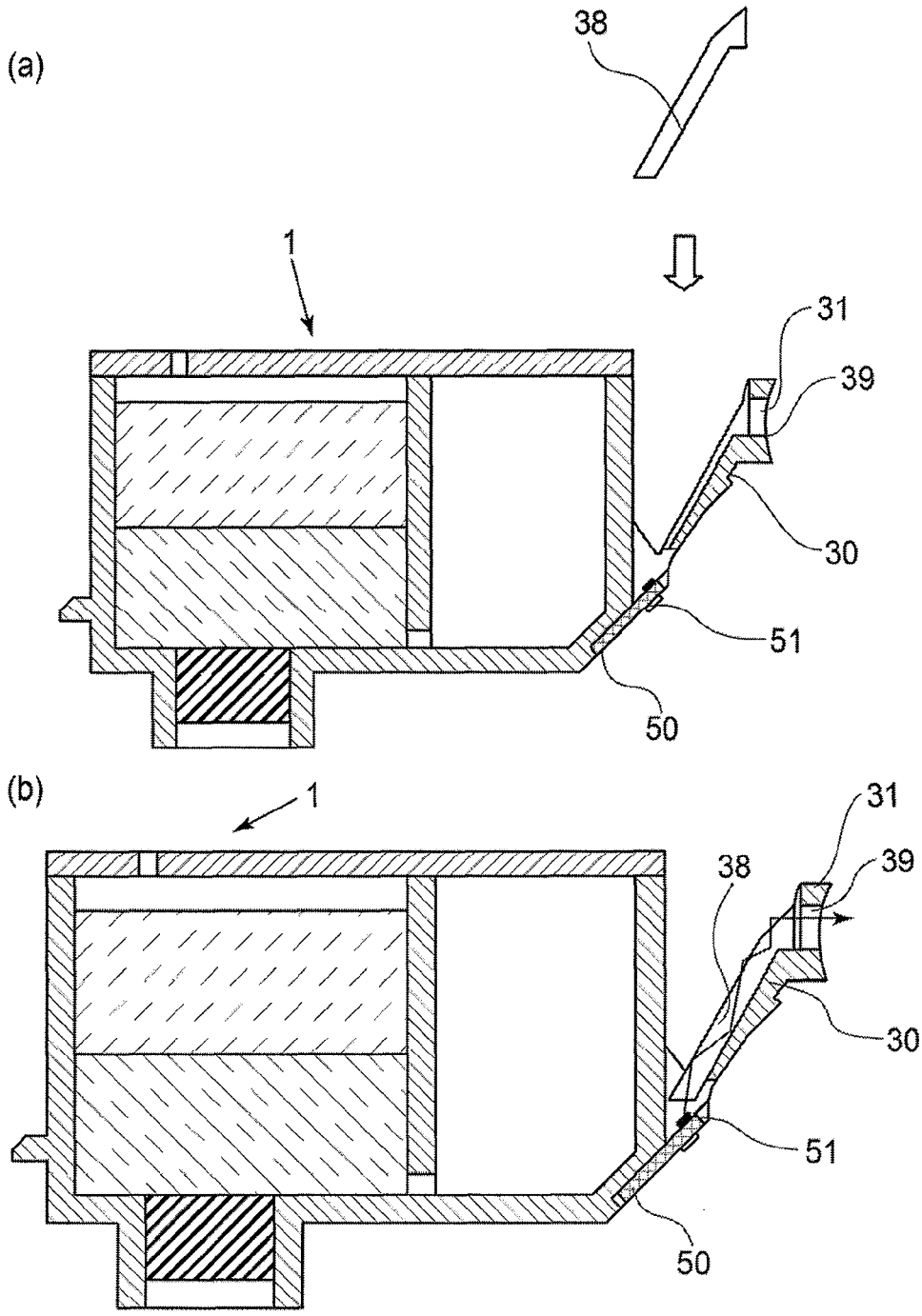
FIGS. 9(*a*) and 9(*b*) are sectional views for illustrating Third Embodiment.
Figure 10:
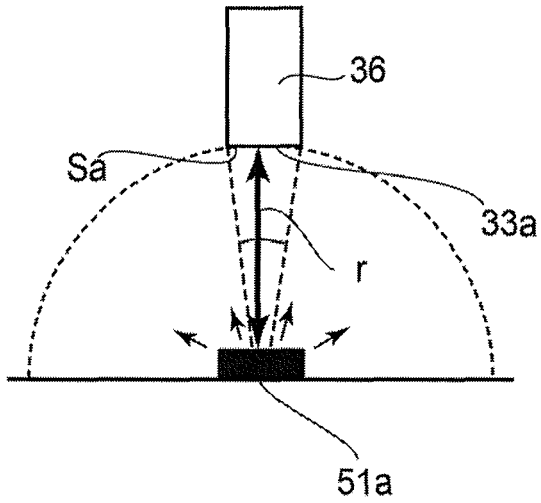
FIGS. 10(*a*) and 10(*b*) are schematic views for illustrating a relationship between an amount of received light and a distance between a light emitting portion and a light receiving portion.
Figure 10:
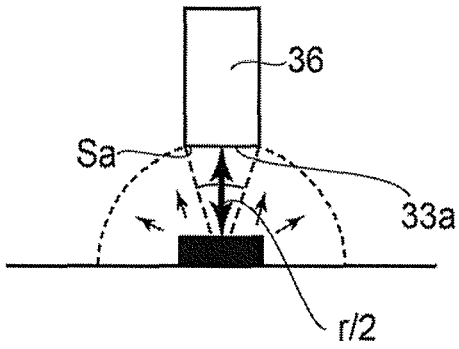

FIGS. 9(*a*) and 9(*b*) illustrate Third Embodiment. In First and Second Embodiments, the structure of the central portion of the supporting member itself is made thick so as to function as the light guide portion 36. As the function of the light guide portion 36, efficient transmission of light is required but in First and Second Embodiments, a light transmission characteristic is subjected to restriction by the material constituting the ink container. On the other hand, in this embodiment, a light guide portion 38 is constituted as a structure different from the supporting member 30 and is configured to be mounted to the supporting member 30, thus permitting free design which is not subjected to restriction by the constituent material. Further, selection or the like of the constituent material and such a shape that the light reflection from the light receiving portion 33 to the display portion can be provided in a most satisfactory manner, so that high-efficiency light transmission can be achieved.

The constitution of the light guide portion 38 shown in FIGS. 9(*a*) and 9(*b*) is merely as example and therefore modification of the constitution of the light guide portion within a range satisfying intent of this embodiment is embraced in this embodiment.

In the constitution shown in FIGS. 9(*a*) and 9(*b*), an opening 39 is provided at the operating portion 31 of the supporting member 30 and constitutes the display portion for outputting the light from the light guide portion 38 mounted as the separate member.

In this embodiment, in the case where the ink container constituent material is an opaque material, the light guided through the light guide portion 38 does not diffuse into the entire supporting member 30, so that only the surface of the light guide portion 38 visible through the opening 39 emits the light and the light does not diffuse into the adjacent supporting member for the ink container. For that reason, viewability of the display portion is enhanced.

In the above-described embodiments, the constitution in which the part of the supporting member is configured to function as the light guide portion 36 and the constitution in which the light guide member 38 is the separate member different from the supporting member 30 are described.

In these constitutions, the light emitted from the LED 51 is conveniently described as light guided to the display portion through the light guide portion but a portion formed of a light-transmissive material functions as the light guide portion since the light passes through the portion formed of the light-transmissive material by its nature.

In the above-described constitutions, a portion constituting a principal light path or a portion to be expected to constitute the principal light path is described as the light guide portion.

The light path from the light-receiving portion to the display portion can be freely designed by appropriately combining shapes or materials capable of changing a refractive index of the light. For example, it is possible to employ light paths from the light-receiving portion to the display portion as shown in FIGS. 12(*a*) to 12(*f*).

In each of FIGS. 12(*a*) to 12(*f*), the light path of a member constituted by a first member (e.g., the supporting member) 100 and a second member (e.g., the light guide member) 101 is represented by an arrow 102. A light-incident portion is the light-receiving portion and a light-outputting portion is the display portion.

FIG. 12(*a*) shows a constitution in which the entire second member functions as the light guide member and the constitution described in Third Embodiment corresponds to this constitution. FIG. 12(*b*) shows a constitution in which the light passing through the second member is changed in light path to the first member at an intermediary portion and the constitutions described in, e.g., First Embodiment and Second Embodiment correspond to this constitution. FIG. 12(*c*) shows a constitution in which the entire first member functions as the light guide member. FIG. 12(*d*) shows a constitution in which the light path is changed from the first member to the second member. FIG. 12(*e*) shows a constitution in which the light path is changed from the second member to the first member and then is changed to the second member again. FIG. 12(*g*) shows a constitution in which the light path is changed from the first member to the second member and then is changed to the first member again.

In order to change the light path, e.g., a desired portion to be changed is configured to face an air layer, changed in material therefor, or utilize a mirror surface 103 or total reflection, thus changing the light path.

Particularly, the constitutions shown in FIGS. 12(*a*) and 12(*b*) are, as described above in First to Third Embodiments, capable of being simply constituted and capable of guiding the light with reliability, thus being excellent in practicality.

Figure 11:
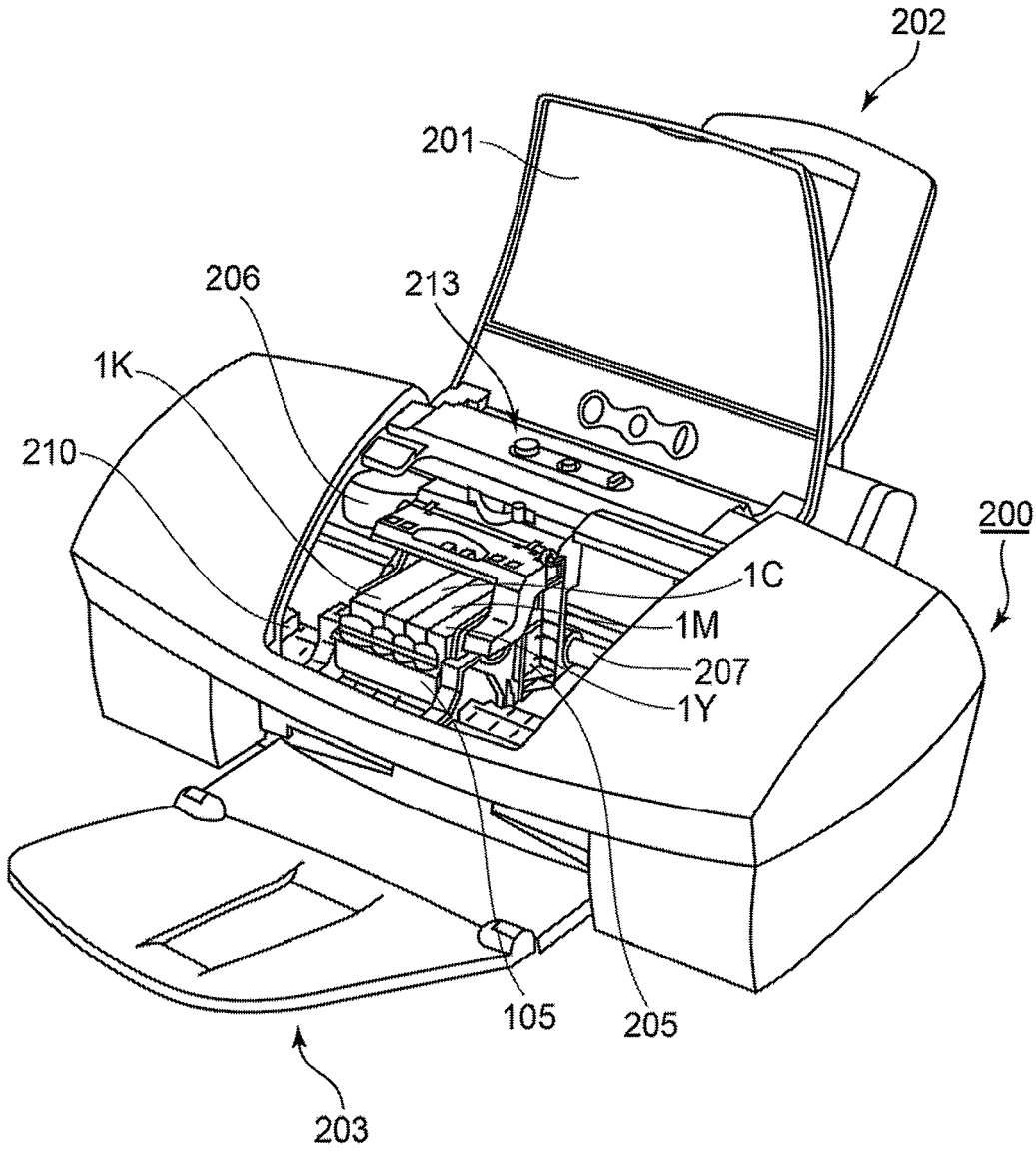
FIG. 11 is a perspective view showing a state in which a main assembly cover 201 of an ink jet printer, for effecting recording, to which an ink container according to an embodiment of the present invention is mounted is opened.
Figure 12D:
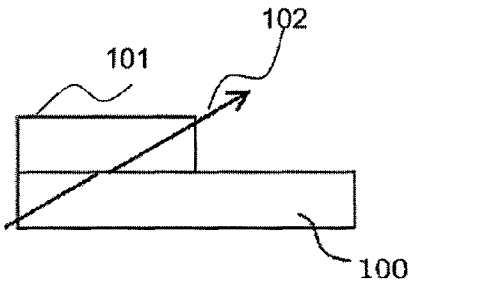
FIGS. 12(*a*) to 12(*f*) are schematic views each for illustrating a constitution of a light path from a light-receiving portion to a display portion.
Figure 12E:
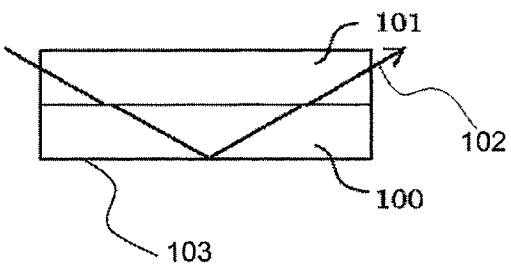
Figure 12F:
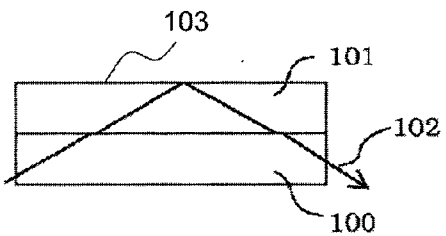
Figure 12A:
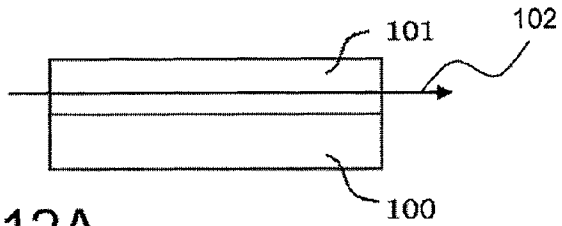
Figure 12B:
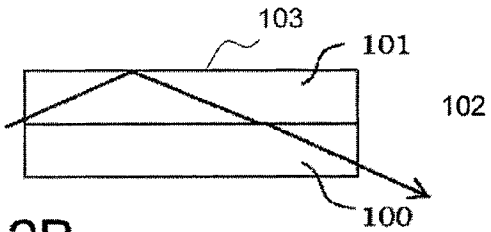
Figure 12C:
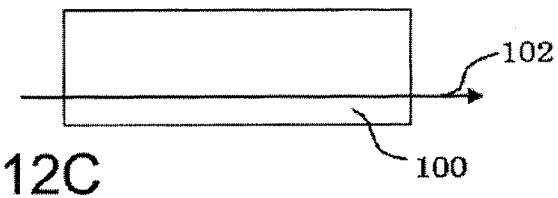

FIG. 11 is a perspective view showing a state of an ink jet printer 200 to which the ink container described above is mounted for effecting recording and in which the main assembly cover 201 of the printer is open.

As shown in FIG. 11, the printer 200 of this embodiment includes major parts thereof including a mechanism for scanningly moving a carriage carrying the recording heads and the ink containers and for effecting the recording during the movement of the carriage. The printer 200 also includes a printer main assembly covered with a main assembly cover 201 and other case portions, a sheet discharge tray 203 at the front side of the main assembly, and an automatic sheet feeding device (ASF) 202 at the rear side of the main assembly. There is further provided an operating panel portion 213 which includes a displaying device for displaying a state of the printer in both states in which the main assembly cover is closed and opened, a main switch, and a reset switch.

As shown in FIG. 11, when the main assembly cover 201 is open, the user can see the movable range of the carriage 205 which carries the recording head unit 105 and the ink containers 1K, 1Y, 1M and 1C, and the neighborhood of the carriage 205. Actually, when the main assembly cover 201 is opened, a sequence operation is carried out so that the carriage 205 is automatically comes to a substantially center position (hereinafter referred to as a "container exchanging position"), where the user can perform an exchanging operation or the like of each of the ink containers.

In the printer of this embodiment, the recording head (unshown) in the form of a chip is provided to the recording head unit 105, corresponding to the respective inks. The recording heads scan the recording material such as paper (sheet) by the movement of the carriage 205, during which the recording heads eject the ink to effect the recording. That is, the carriage 205 is slidably engaged with a guiding shaft 207 which extends in the moving direction thereof and can accomplish the above-described movement by a carriage motor and is driving force transmitting mechanism. The recording heads corresponding to the K, Y, M and C (black, yellow, magenta and cyan) inks eject the inks on the basis of ejection data fed from a control circuit provided in the main assembly side through a flexible cable 206. There is provided a paper feeding mechanism including a paper feeding roller, a sheet discharging roller and so on to feed the recording material (unshown) fed from the automatic sheet feeding device 202 to the sheet discharge tray 203. The recording head unit 105 integrally provided with the ink container holder is detachably mounted on the carriage 205, and the respective ink containers 1 are detachably mounted on the recording head unit 105 in the form of a cartridge. That is, the recording head unit 105 can be mounted on the carriage 205 and the ink containers 1 can be mounted on the recording head unit 105, so that the ink containers 1 are detachably mountable to the carriage 205 through the recording head unit 105.

During the recording (or printing) operation, the recording heads scan the recording material by the above-described movement, during which the recording heads eject the inks onto the recording material to effect the recording on a width of the recording material corresponding to the range of the ejection outlets of the recording head. In a time period between a scanning operation and the next scanning operation, the paper feeding mechanism feeds the recording material through a predetermined distance corresponding to the width, so that the recording is sequentially effected with respect to the recording material. At an end portion of the movement range of the recording head by the movement of the carriage, an ejection refreshing unit including caps for capping surfaces of the respective recording heads where associated ejected outlets are disposed is provided. As a result, the recording heads move to the position in which the refreshing unit is provided at predetermined time intervals, and are subjected to the refreshing process including the preliminary ejections or the like.

The recording head unit 105 having a holder portion for each ink container 1, as described above, is provided with a connector corresponding to each of the ink containers, and the respective connectors contact the pads of the substrate provided on the ink container 1. As a result, the control of turn-on or flickering of each of the above-described light receiving portions (LEDs) are enabled.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 092167/2008 filed Mar. 31, 2008 and 082769/2009 filed Mar. 30, 2009, which are hereby incorporated by reference.

What is claimed is:

1. An ink container comprising:

a body configured to retain ink;

a latch lever which has a fixed end connected to the body and a free end, the latch lever being movable between a first position in which a distance between the free end and the body is a first distance and a second position in which a distance between the free end and the body is a second distance smaller than the first distance;

a light emitting portion which is positioned closer to the fixed end than to the free end; and a light guide member provided on the latch lever and movable in conjunction with the latch lever, the light guide member (i) having a light receiving portion configured to receive light from the light emitting portion when the latch lever is at the second position and a light-outputting portion configured to output the light and (ii) being configured to guide the light from the light receiving portion to the light-outputting portion, wherein a distance between the light receiving portion and the light emitting portion when the latch lever is at the second position is smaller than a distance between the light receiving portion and the light emitting portion when the latch lever is at the first position.

2. An ink container according to claim 1, wherein the latch lever is elastically deformable toward the body and is movable from the first position to the second position by an elastic deformation of the latch lever, and wherein the latch lever is elastically deformed at the second position and is not elastically deformed at the first position.

3. An ink container according to claim 1, wherein when the latch lever is at the second position, the light receiving portion is spaced from the light emitting portion.

4. An ink container according to claim 1, wherein the light guide member extends along the latch lever, and the light receiving portion is provided at an end portion of the light guide member in a longitudinal direction of the light guide member.

5. An ink container according to claim 4, further comprising:

an electrical contact electrically connected with the light emitting portion, and a substrate provided with the electrical contact and the light emitting portion, wherein the substrate is closer to the fixed end than to the free end.

6. An ink container according to claim 5, wherein the light receiving portion has a light receiving surface which moves downward when the light guide member moves from the first position to the second position.

7. An ink container according to claim 6, wherein the light emitting portion is provided adjacent to the fixed end of said latch lever.

8. An ink container according to claim 7, wherein the light guide member has a light reflection portion, and wherein the light guide member is configured to guide the light from the light receiving portion to the light-outputting portion by repetition of light reflection off the light reflection portion.

9. An ink container according to claim 5, wherein the light emitting portion is provided adjacent to the fixed end of said latch lever.

10. An ink container according to claim 9, wherein the light guide member has a light reflection portion, and wherein the light guide member is configured to guide the light from the light receiving portion to the light-outputting portion by repetition of light reflection off the light reflection portion.

11. An ink container according to claim 5, wherein the light guide member has a light reflection portion, and wherein the light guide member is configured to guide the light from the light receiving portion to the light-outputting portion by repetition of light reflection off the light reflection portion.

12. An ink container according to claim 11, wherein the light receiving portion has a light receiving surface which moves downward when the light guide member moves from the first position to the second position.

13. An ink container according to claim 4, wherein the light emitting portion is provided adjacent to the fixed end of said latch lever.

14. An ink container according to claim 13, wherein the light guide member has a light reflection portion, and wherein the light guide member is configured to guide the light from the light receiving portion to the light-outputting portion by repetition of light reflection off the light reflection portion.

15. An ink container according to claim 4, wherein the light receiving portion has a light receiving surface which moves downward when the light guide member moves from the first position to the second position.

16. An ink container according to claim 15, wherein the light emitting portion is adjacent to the fixed end of said latch lever.

17. An ink container according to claim 16, wherein the light guide member has a light reflection portion, and wherein the light guide member is configured to guide the light from the light receiving portion to the light-outputting portion by repetition of light reflection off the light reflection portion.

18. An ink container according to claim 4, wherein the light guide member has a light reflection portion, and wherein the light guide member is configured to guide the light from the light receiving portion to the light-outputting portion by repetition of light reflection off the light reflection portion.

19. An ink container according to claim 1, wherein the light receiving portion has a light receiving surface opposed to the light emitting portion when the latch lever is at the second position.

20. An ink container according to claim 1, wherein the light emitting portion is provided adjacent to the fixed end of said latch lever.

21. An ink container according to claim 1, wherein the latch lever and the light guide member are integral with each other.

22. An ink container according to claim 1, wherein the latch lever and the light guide member are made of same material.

23. An ink container according to claim 1, wherein a material of the latch lever is different from a material of the light guide member.

24. An ink container according to claim 1, wherein the light guide member is attached to the latch lever.

25. An ink container according to claim 1, wherein the light guide member is removable from the latch lever.

26. An ink container according to claim 1, further comprising:

an electrical contact electrically connected with the light emitting portion, and a substrate provided with the electrical contact and the light emitting portion, wherein the substrate is closer to the fixed end than to the free end.

27. An ink container according to claim 1, wherein the light receiving portion of the light guide member is rotationally displaced around a base portion of the light guide member adjacent to the light receiving portion in moving from the first position to the second position.

* * * * *